US006497117B2

(12) United States Patent
Ofiesh, II

(10) Patent No.: US 6,497,117 B2
(45) Date of Patent: Dec. 24, 2002

(54) JEWELRY RING

(76) Inventor: Gabriel D. Ofiesh, II, P.O. Box 2002, Charlottesville, VA (US) 22902

( * ) Notice: Subject to any disclaimer, the term of this patent is extended or adjusted under 35 U.S.C. 154(b) by 0 days.

(21) Appl. No.: 09/900,158

(22) Filed: Jul. 9, 2001

(65) Prior Publication Data

US 2001/0039733 A1 Nov. 15, 2001

Related U.S. Application Data

(62) Division of application No. 09/318,602, filed on May 26, 1999, now Pat. No. 6,295,732.

(51) Int. Cl.[7] ..... A44C 19/00

(52) U.S. Cl. ..... 63/15; 63/1.11; 63/1.16; 63/3; 63/15.4; 63/31

(58) Field of Search ..... 63/1.11, 1.16, 63/3, 15, 15.1, 15.4, 26, 31

(56) References Cited

U.S. PATENT DOCUMENTS

| | | | | | |
|---|---|---|---|---|---|
| 221,728 | A | | 11/1879 | Halsey | |
| 309,531 | A | | 12/1884 | Eades | |
| 613,243 | A | | 11/1898 | Carroll et al. | |
| 1,327,606 | A | | 1/1920 | Bacharach | |
| 1,431,652 | A | | 10/1922 | Grossman | |
| 1,586,606 | A | | 6/1926 | Cain | |
| 1,972,128 | A | * | 9/1934 | Bobbroff | 63/15 |
| 2,060,345 | A | * | 11/1936 | Phillips | 63/3 |
| D136,481 | S | | 10/1943 | Bartmess | |
| D184,833 | S | | 4/1959 | Sager | |
| D215,329 | S | | 9/1969 | Shiman | |
| 4,226,094 | A | | 10/1980 | Wolpoff | |
| D262,271 | S | | 12/1981 | Barr | |
| D266,062 | S | | 9/1982 | Austin | |
| D271,187 | S | | 11/1983 | Bulgari | |
| 4,977,757 | A | * | 12/1990 | Mesica et al. | 63/15 |
| 5,161,392 | A | | 11/1992 | Wiriath et al. | |
| D337,543 | S | | 7/1993 | Caldow | |
| 5,228,316 | A | | 7/1993 | Meyrowitz | |
| 5,678,428 | A | | 10/1997 | Pasquetti | |
| 6,293,034 | B1 | * | 9/2001 | Skapyak et al. | 40/310 |
| 6,295,732 | B1 | * | 10/2001 | Ofiesh, II | 29/896.412 |

FOREIGN PATENT DOCUMENTS

| | | |
|---|---|---|
| AU | 208883 | 8/1956 |

* cited by examiner

*Primary Examiner*—J. J. Swann
*Assistant Examiner*—Andrea Chop
(74) *Attorney, Agent, or Firm*—Edell, Shapiro, Finnan & Lytle, LLC

(57) ABSTRACT

A jewelry ring assembly includes a base ring having an annular channel on its outer surface and a retained ring disposed in that channel to be freely rotatable about the base ring and capable of wobbling in the channel. The base ring is a single piece of metal and its retaining channel is smoothly concave in width between raised annular edges. The base ring is formed from a cylindrical blank initially having a constant outside diameter across its width, which diameter is smaller than the retained ring inside diameter. The method of fabricating the ring assembly begins with flaring one edge radially outward to a final diameter larger than the retained ring inside diameter. The retained ring is moved over the unflared edge, after which that edge is also flared to the final diameter. Enlarging the annular edges in separate steps permits the base ring to be formed from a single piece of metal while presenting a retaining channel having a smooth concave width.

13 Claims, 1 Drawing Sheet

JEWELRY RING

CROSS-REFERENCE TO RELATED APPLICATION

This application is a divisional of U.S. patent application Ser. No. 09/318,602, filed May 26, 1999, entitled "Jewelry Ring", now U.S. Pat. No. 6,295,732.

BACKGROUND OF THE INVENTION

1. Technical Field

The present invention pertains to an improved jewelry ring assembly of the type having two annular rings, one movably retained by the other, and to the method of manufacturing such assembly. Although the preferred embodiment described herein is a finger ring, it will be understood that the principles of the invention apply equally to rings worn on other parts of the body or suspended from chains, pins and the like.

2. Discussion of the Prior Art

It is known in the prior art to manufacture finger ring assemblies made of two rings, namely a base or inner ring that fits on the wearer's finger, and a retained or outer ring that is engaged by the base ring. Example of such ring assemblies are found in U.S. Pat. Nos. 1,431,652 (Grossman), 1,586,606 (Cain), 5,161,392 (Wiriath et al.), 5,228,316 (Meyrowitz), 5,678,428 (Pasquetti) and Australian Patent No. 208883 (Preston). The ring assemblies disclosed in the Cain, Wiriath et al., Meyrowitz and Pasquetti patents are made from at least three parts which are assembled in various manners. In order to place and then retain the outer ring on the outside surface of the base ring, the base ring is provided in two pieces that are joined together after the outer ring is in place. The need for a two-piece base ring arises from the fact that annular edges of greater outside diameter than the inside diameter of the retained ring are required in order to hold the retained ring on the base ring. This required size relationship, however, prevents placement of the outer ring onto the base ring unless the base ring is initially disassembled.

The Grossman and Preston patents disclose respective ring assemblies wherein the base ring is made of a single piece. The outer surface of the base ring has an annular channel disposed between two raised annular edges of greater diameter. The base ring is initially sized such that the outside diameter of the annular edges is slightly smaller than the inside diameter of the retained ring, thereby permitting the retained ring to be moved axially over one of the edges of the base ring and into alignment with the base ring channel. The base ring is then radially expanded whereby both its channel and its retaining edges experience a diametric increase until the aligned retained ring is disposed within the base ring channel between the annular retaining edges. The expansion ultimately causes the retained ring to fit tightly as an inset in the base ring channel, the tight fit preventing relative movement of the two rings in the final assembly.

It is aesthetically desirable to provide a jewelry ring assembly of the type described wherein the retained ring is both freely rotatable about the base ring and capable of freely wobbling (i.e., axially skewing) between the outer retaining edges of the base ring channel. It is also aesthetically desirable that the retaining edges of the base ring be formed as a smooth transition from the base ring channel rather than providing a sharp step or right angle transition between the channel and retaining edges. It is further desirable that the base ring be made of a single piece rather than two parts that must be assembled after the retained ring is in place. None of the ring assemblies described above meet all of these criteria.

OBJECTS AND SUMMARY OF THE INVENTION

It is an object of the present invention to provide a ring assembly of the type described wherein the base ring is formed from a single piece, the retained ring is free to rotate and wobble in the base ring channel, and the base ring channel has a smooth concave transition between its deepest part and its retaining edges.

In accordance with the present invention, a ring assembly includes two pieces, namely a base ring and a retained ring. The one-piece base ring is initially a right circular cylinder with a constant diameter throughout its width (i.e., its axial length). That outside diameter is necessarily smaller than the inside diameter of the retained ring. The first step in the fabrication process is to flare a first of the annular edges of the base ring radially outward so that there is a gradual increase in diameter from the middle portion of the outer surface to the first annular edge. The diameter of the enlarged first annular edge is increased such that it exceeds the inside diameter of the retained ring.

The retained ring is then placed about the base ring by moving the retained ring axially past the second or unenlarged edge of the base ring. With the two rings thusly in place, the second edge of the base ring is flared radially outward such that the outside diameter of the second edge is greater than the inside diameter of the retained ring. This flaring also produces a smooth or gradual increase in diameter of the outer surface of the base ring. The resulting base ring has an outer surface in the form of an annular channel extending widthwise in a smoothly concave manner between the diametrically expanded annular edges of the base ring. The retained ring inside diameter is sufficiently large relative to the outside diameter of the central portion of the concave base ring channel to permit the retained ring to freely rotate about the base ring in that channel. In addition, the width of the retained ring is sufficiently small relative to the width of the base ring channel to permit axial wobble of the retained ring in that channel.

The smooth widthwise transition from edge to edge of the base ring provides a free-flowing aesthetic appearance while movably retaining the retained ring in the concave annular base ring channel.

The above features and advantages of the present invention will become apparent upon consideration of the following detailed description of specific embodiments thereof, particularly when taken in conjunction with the accompanying drawings wherein like reference numerals in the various figures are utilized to designate like components.

DESCRIPTION OF THE PREFERRED EMBODIMENTS

Figure 1:
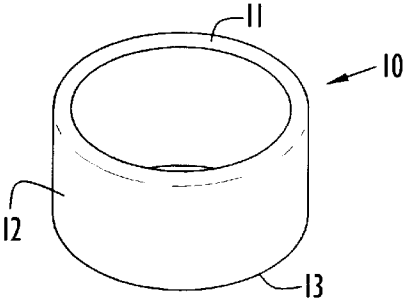
FIG. 1 is a view in perspective of a base ring blank utilized in the method and apparatus of the present invention.

Referring specifically to FIG. 1 of the accompanying drawings, a preferred method according to the present invention begins with forming a jewelry ring blank 10 in the shape of a right circular cylinder of known width (i.e., axial length), thickness and diameter. Methods for making such a blank are conventional and need not be described herein. Blank 10 is typically gold, although other metals, combinations of metals or even plastic materials may be employed within the scope of the present invention. The outer surface 12 of ring blank 10 preferably has a constant diameter throughout its entire width (i.e., the axial length of the cylinder). Where or not the outside diameter is constant, that diameter must be smaller at least at one annular edge than the inside diameter of a retained ring 30 illustrated in FIGS. 4, 5 and 6 and described in detail hereinbelow.

Figure 3:
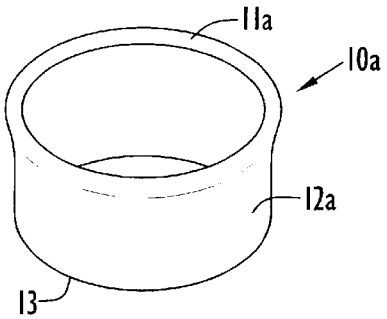
FIG. 3 is a view in perspective of the blank of FIG. 1 after the first annular edge thereof has been enlarged.
Figure 2:
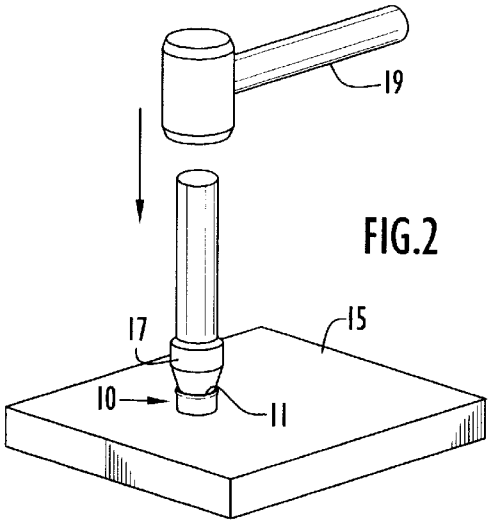
FIG. 2 is a view in perspective of the base ring blank of FIG. 1 in the process of having a first annular edge thereof enlarged in accordance with one step of the method of the present invention.

The first step in the manufacturing process is to flare a first annular edge 11 of base ring blank 10 radially outward. One way to perform the required flaring is illustrated in FIG. 2. Initially, blank 10 is annealed, if necessary, to a degree of softness consistent with the flaring step. The blank 10 is then placed with its second annular edge 13 on a suitable work surface such as a steel block or platform 15. A tapered steel punch or mandrel 17 of suitable size and taper has its narrow end inserted axially into blank 10 through the exposed first annular edge 11. Mandrel 17 is sized and tapered such that its narrow end can be inserted partially into ring blank 10 while the tapered mandrel surface abuts annular edge 11 interiorly of the blank. A forging hammer 19 is then used to strike the upper end of mandrel 17, thereby imparting axial forces that urge the tapered portion of the mandrel further into blank 10. As a consequence, the upper annular edge 11 of the blank is forced radially outward. The mandrel is struck thusly a sufficient number of times to achieve the desired degree of flaring of outer surface 12 of the blank. The resulting partially processed blank 10*a*, with annular edge 11*a* flared outward, is illustrated in FIG. 3. It will be noted that the diametric transition of outer surface 12*a* from the original diameter to the flared diameter is smooth as opposed to being sudden of stepped.

A further step in the process of the present invention is the fabrication of a retained ring 30 in any suitable conventional manner. Retained ring 30 is much smaller in width (i.e., axial length) than base ring blank 10. In addition, retained ring 30 has an inside diameter which is larger than the outside diameter of surface 12 of the original unprocessed based ring blank 10, but smaller than the outside diameter of flared annular edge 11*a*. In the preferred embodiment the minimum outside diameter portion of the retaining channel is smaller than the inside diameter of the retained ring by less than ten percent. Retained ring 30 may be of any suitable metal, combination of metals or even plastic. Preferably, but not necessarily, the material of retained ring 30 contrasts with the material of the base ring in some manner, such as color, surface design, etc. In one exemplary embodiment, the base ring may be made of yellow gold and the retained ring made of white gold.

Figure 5:
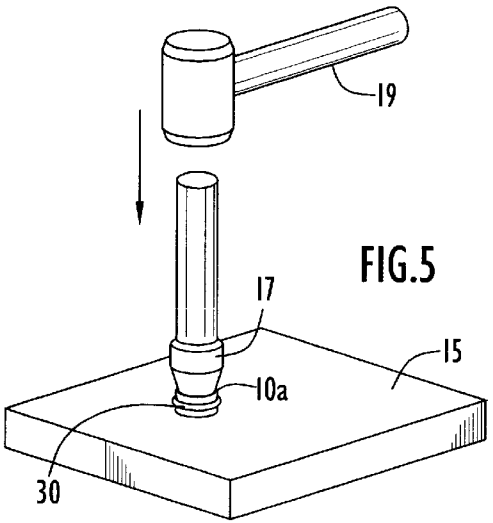
FIG. 5 is an illustration of a further step in the process of the present invention whereby the second annular edge of the processed blank of FIG. 3 is enlarged.
Figure 4:
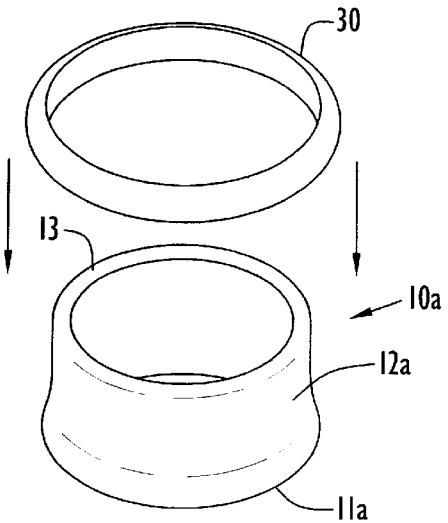
FIG. 4 is an exploded view illustrating placement of a retained ring over the processed blank of FIG. 3.

Referring to FIGS. 4 and 5, the retained ring is placed about partially processed base ring blank 10*a* by first turning the base ring blank over so that its flared annular edge 11*a* rests on platform 15. Retained ring 30 is then placed about the outside surface 12*a* of blank 10*a* by moving the retained ring axially over the unprocessed and now uppermost annular edge 13 of the blank. The retained ring is prevented from moving past the entire width of blank 10*a* and into contact with platform 15 by the flared annular edge 11*a*.

Figure 6:
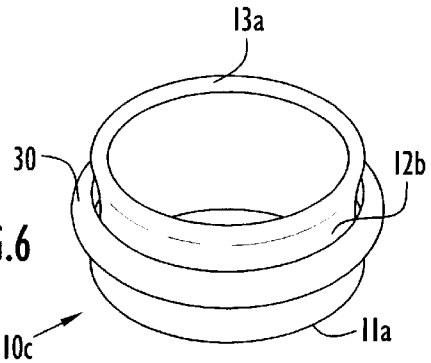
FIG. 6 is a view in perspective of the completed jewelry ring assembly of the present invention.

Annular edge 13 of blank 10*a* is diametrically flared in the same manner described above using mandrel 17 and hammer 19. As illustrated in FIG. 6, the resulting outside diameter of flared annular edge 13*a* of the final base ring 10*c* is greater than the inside diameter of retained ring 30, whereby the retained ring is trapped or retained in the annular channel 12*b* formed between flared annular edges 11*a* and 13*a*. The width dimension of annular channel 12*b* is smoothly concave with no step or sudden transitions.

The depth of channel 12*b* in base ring 10*c* can be modified as desired using a cylindrical punch (as opposed to a tapered punch), suitably sized to diametrically expand the portion of the base ring between the flared annular edges. In addition, the base ring blank may require annealing at different times during the overall process to permit the various shaping steps to be accomplished.

It is to be understood that either the base ring or retained ring, or both can be inset with diamonds or other gems, or surface treated with any desirable design to please one's aesthetically sense. The final ring assembly as illustrated in FIG. 6 may be a finger ring, a ring worn on a chain, a ring suspended from an ear lobe attachment as an earring, or any other suitable ring used as jewelry.

The particular flaring steps illustrated and described herein are included by way of a preferred exemplary embodiment and should not be considered limiting on the scope of the present invention. Any technique for providing a smooth and continuous concave channel for retaining the outer ring may be employed within the scope of the invention.

Figure 7:
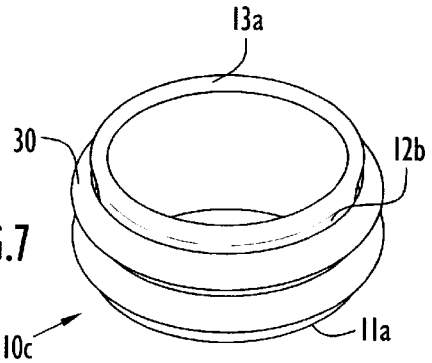
FIG. 7 is a view in perspective of the completed Jewelry Ring assembly of the present invention showing two retained rings.

Although the embodiment described and illustrated herein has a single outer or retained ring, it will be understood that the principles of the present invention apply equally as well to retaining two or more outer rings on a single base ring. The method of making such a ring is substantially the same as described hereinabove, except that plural outer or retained rings are placed on the base ring after one base ring edge is flared but before the other edge is flared. A ring assembly with two retained rings as illustrated in FIG. 7.

As described above, it is preferred that the contour of channel 12*c* be such as to permit the retained ring 30 to wobble or tilt freely therein. This wobble motion is in addition to the free rotatability of the retained ring in channel 12*c*.

The annular portion of the retaining channel 12*b* which has the smallest outside diameter is typically, although not necessarily, at the center of the width dimension of base ring 10*c*. By of example only, for a base ring having a width of 1 mm, the retained ring is typically three to three and one-half ring sized larger than the base ring. The important point in this regard is that the diameter difference need only be enough to permit the retained ring to freely rotate about the base ring.

The base ring must, of course, be thicker than the retained ring in order for the retained ring to be held within the base ring retaining channel 12*b*. The difference in width between the two rings is primarily a matter of aesthetic taste but is limited by the requirement that the retained ring be capable of wobbling within the base retaining channel. This feature is also affected by the rate of change of the outside diameter of the retaining channel 12*b* versus the width of the retained ring 30. It is necessary, therefore, that the portion of channel 12*b* having an outside diameter smaller than the retained ring inside diameter be greater in width than the retained ring. By way of example only, the base ring overall width may be three to four times the retained ring width, and the width of the smaller diameter channel portion may be twice the retained ring width.

What has been disclosed herein is a unique two-piece ring made of a base ring and a retained ring. The base ring is made of a single piece of metal or other material and is shaped to provide an annular channel having a width dimension that is smoothly concave between the annular edges of the base ring. Also disclosed herein is a unique method for fabricating such a ring by selectively shaping the annular edges of the base ring member to permit those edges to retain the outer ring on the base ring without requiring a two-piece ring and without requiring the sharp transitions found necessary in prior art devices of this general type.

Having described preferred embodiments of a new and improved ring assembly and method of making same, this believed that other modifications, variations and changes will be suggested to persons in the art in view of the teaching set forth herein. It is therefore to be understood that all such variations, modifications and changes are considered to fall within the scope of the present invention as defined by the appended claims.

What is claimed:

1. A jewelry ring assembly comprising:

a retained ring having a predetermined inside diameter:

a base ring consisting of a single piece, said base ring having first and second annular outer edges and an outer surface configured as an annular retaining channel extending widthwise between said first and second annular edges, said retaining channel being smoothly concave throughout its entire width dimension;

wherein said base ring is thicker than said retained ring;

wherein said base ring and annular edges have outside diameters that are larger than said inside diameter of said retained ring; and wherein said retaining channel has a minimum outside diameter portion sufficiently smaller than said inside diameter of said retained ring to permit said retained ring to rotate freely about said base ring and to wobble in said channel.

2. The ring assembly of claim 1 wherein said outside diameter of said annular edges of said base ring are equal.

3. The ring assembly of claim 1 wherein the width of the retaining channel portion having an outside diameter smaller than the inside diameter of said retained ring is at least twice the width of said retained ring.

4. The ring assembly of claim 1 wherein said minimum outside diameter portion of said retaining channel is smaller than the inside diameter of said retained ring by less than ten percent.

5. A ring assembly comprising:

a unitary single piece base ring having a radially outward facing outside surface with an annular retaining channel defined between upstanding annular edges;

a first retained ring having a predetermined inside diameter and retained in said retaining channel;

wherein said base ring is formed as a unitary, single metal piece having an outside diameter smaller than the predetermined inside diameter of the first retained ring and a width between said annular edges greater than the width of the first retained ring, whereby the first retained ring is trapped in the annular retaining channel defined between the annular edges of the base ring;

wherein said retaining channel in the single piece base ring has a minimum outside diameter portion sufficiently smaller than said predetermined inside diameter of said first retained ring to permit said first retained ring to both rotate freely in said retaining channel about said base ring and to wobble in said retaining channel.

6. The ring assembly of claim 5 further comprising a second retained ring disposed in said retaining channel and configured to both rotate freely in said retaining channel about said base ring and to wobble in said retaining channel.

7. The ring assembly of claim 5 further comprising a plurality of retained rings disposed in said retaining channel and configured to both rotate freely in said retaining channel about said base ring and to wobble in said retaining channel.

8. A ring assembly comprising:

a base ring having a radially outward facing outside surface with a smoothly concave annular retaining channel defined between upstanding annular edges;

at least a first retained ring having a predetermined inside diameter and retained in said retaining channel;

wherein said base ring is a unitary, single metal piece having an outside diameter smaller than the predetermined inside diameter of the retained ring and a width between said annular edges greater than the width of the retained ring, whereby the retained ring is trapped in the annular retaining channel defined between the annular edges of the base ring;

wherein said retaining channel in the single piece base ring has a minimum outside diameter portion sufficiently smaller than said predetermined inside diameter of said retained ring to permit said retained ring to both rotate freely in said retaining channel about said base ring and to wobble off-axis in said retaining channel.

9. The ring assembly of claim 8 comprising at least a second retained ring wherein said first and second retained rings are each disposed in said retaining channel for free rotation therein about said base ring and for off-axis wobbling in said retaining channel.

10. The ring assembly of claim 8 wherein said base ring is a precious metal.

11. A ring assembly in which a retained ring is retained in an annular retaining channel of a unitary, single-piece metal base ring and is both axially rotatable freely about the base ring and capable of wobbling in the channel, said channel being defined between first and second annular edges of the base ring, said edges extending radially outward to a diameter greater than the inside diameter of the retained ring.

12. A ring assembly comprising at least one retained ring trapped on the outer surface of a unitary single piece base ring, wherein the outside surface of the base ring is an annular retaining channel of sufficient depth and width relative to the inside diameter and thickness, respectively, of the at least one retained ring to permit the at least one retained ring to both rotate freely in said annular retaining channel about said base ring and wobble off axis in said annular retaining channel while preventing the at least one retained ring from moving axially out of the retaining channel.

13. A ring assembly comprising a plurality of retained rings trapped on the outer surface of a unitary, single piece base ring, the outside surface of the base ring having an annular retaining channel of sufficient depth and width relative to the inside diameter and thickness, respectively, of each of the plurality of retained rings to permit the plurality of retained rings to both rotate freely in said annular retaining channel about said base ring and wobble off axis in said annular retaining channel while preventing the retained rings from moving axially out of the retaining channel.

* * * * *